United States Patent [19]

Upchurch

[11] Patent Number: 4,560,000

[45] Date of Patent: Dec. 24, 1985

[54] PRESSURE-ACTIVATED WELL PERFORATING APPARATUS

[75] Inventor: James M. Upchurch, Sugar Land, Tex.

[73] Assignee: Schlumberger Technology Corporation, New York, N.Y.

[21] Appl. No.: 476,074

[22] Filed: Mar. 17, 1983

Related U.S. Application Data

[63] Continuation-in-part of Ser. No. 369,209, Apr. 16, 1982.

[51] Int. Cl.[4] ..... E21B 43/116

[52] U.S. Cl. ..... 166/55.1; 175/4.52; 175/4.54; 166/297

[58] Field of Search ..... 166/297, 178, 55, 55.1; 175/4.52, 4.54, 4.56, 296; 102/319

[56] References Cited

U.S. PATENT DOCUMENTS

| | | | |
|---|---|---|---|
| Re. 29,638 | 5/1978 | Nutter | 73/151 |
| 3,011,551 | 12/1961 | Young et al. | 166/55.1 X |
| 3,029,732 | 4/1962 | Greene | 166/297 X |
| 3,189,094 | 6/1965 | Hyde | 166/55.1 X |
| 3,530,948 | 9/1970 | Garrett | 175/4.51 |
| 3,800,705 | 4/1974 | Tamplen | 175/4.54 X |
| 4,369,654 | 1/1983 | Hallmark | 73/151 |

*Primary Examiner*—Stephen J. Novosad
*Assistant Examiner*—David J. Bagnell

[57] ABSTRACT

A well perforating technique utilizes a predetermined pressure difference developed at different points in the borehole to actuate the firing mechanism of a tubing conveyed perforating gun. A first embodiment incorporated as part of a well test string includes a packer for isolating a wellbore interval and a perforating gun connected in the string below the packer which is fired in response to development of a greater pressure in the annulus above the packer than in the isolated interval, thereby causing perforation at "underbalanced" conditions. A modified "full-bore" embodiment has an annular configuration firing mechanism as part of a tubing string and fires the perforating gun in response to development of a predetermined difference between the pressures at a point in the annulus and a point in the central bore of the tubing string.

10 Claims, 9 Drawing Figures

PRESSURE-ACTIVATED WELL PERFORATING APPARATUS

CROSS-REFERENCE TO RELATED APPLICATIONS

This application is a continuation-in-part of Upchurch U.S. patent application Ser. No. 369,209, filed Apr. 16, 1982, entitled "Pressure Responsive Perforating and Testing System."

BACKGROUND OF THE INVENTION

1. Field of the Invention

This invention relates generally to well perforating systems, and particularly to an apparatus for a new and improved perforating system in which differential pressure is employed to activate a perforating device.

2. Description of the Prior Art

Numerous systems have been proposed for perforating a well. Examples of prior art systems employed in combination with a string of tubing or pipe are shown in U.S. Pat. Nos. 2,092,337; 2,169,559; 2,330,509; and 2,760,408. In accordance with these disclosures the firing assembly which activates the perforating gun is actuated by electrical means, pipe string manipulation or by dropping an impact bar (commonly referred to as a "go-devil") through the pipe string. Electrical actuation normally requires that a wireline be run into the pipe string which involves cumbersome and often time-consuming operations. Systems using pipe string manipulation typically include somewhat complicated mechanical constructions, and can be prematurely activated as the pipe string is being run into the well. Systems employing drop bars are not considered to be practical in deviated wells since the bar may not reach bottom. Of course in all cases safety is a primary consideration.

SUMMARY OF THE INVENTION

It is the general object of the present invention to provide an apparatus for a new and improved well perforating system wherein the perforating device can be actuated with increased safety and reliability under controlled well conditions. It is a further object of the invention to provide an apparatus for a new and improved well perforating system wherein actuation of the firing mechanism is responsive to the existence of a predetermined difference between pressures at different locations in the well bore, such as a pressure difference developed across a packer that has been set to isolate an interval of the well.

These and other objects are attained in accordance with the present invention through the provision of a well perforating system comprising means for isolating an interval of a well bore and means for perforating the isolated interval in response to a predetermined difference between the pressure of fluid in the isolated interval and the pressure of fluid in the well annulus outside the isolated interval.

In a preferred embodiment of tubing-conveyed perforating apparatus, described in greater detail below, a perforating device suspended in the well as part of a tubing string is arranged to be selectively activated by a firing mechanism that includes a firing pin spaced above a percussion cap that will ignite a detonating cord when impacted by the firing pin. The firing pin is locked in the spaced position by a locking mechanism which is arranged to be released when a predetermined magnitude of pressure differential is applied thereto. Upon release of the locking mechanism the firing pin is driven into engagement with the percussion cap to cause the perforating device to be actuated. In a modified form of preferred embodiment, the firing mechanism and locking mechanism elements are positioned peripherally of the central bore of the tubing string. This leaves an unobstructed central bore for delivering production fluids to the surface following, perforation, or as an access channel for running other tools into the well.

The firing means of the present invention is pressure actuated, and has simple construction and operability that provides advantages in universal application, including the perforation of highly deviated wells. The system may be actuated in response to a predetermined pressure differential which is developed in a controlled manner, as for example across a well packer or between the annulus and the interior of the tube, thereby providing greater control of the perforating process with attendant increased reliability and safety.

There have thus been outlined rather broadly the more important objects, features, and advantages of the invention in order that the detailed description thereof that follows may be better understood and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the purposes of this invention. It is important, therefore, that this disclosure be regarded as including such equivalent arrangements as do not depart from the spirit and scope of the invention.

BRIEF DESCRIPTION OF THE DRAWINGS

Embodiments of the invention have been chosen for purposes of illustration and description of both the apparatus and method, and are shown in the accompanying drawings forming a part of the specification, wherein.

DESCRIPTION OF THE PREFERRED EMBODIMENTS

Figure 1:
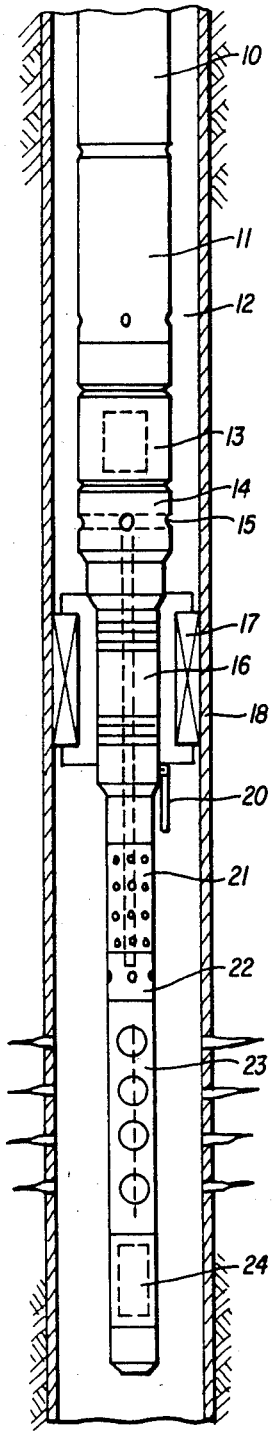
FIG. 1 is a schematic view of an embodiment of a tubing-conveyed well perforating system in accordance with the present invention shown by way of example as part of a test string disposed in a well.

Referring initially to FIG. 1, there is shown schematically a string of formation testing and perforating tools that are suspended in a cased well bore on pipe string 10. The tool string includes a main test valve assembly 11 of the type shown in Nutter U.S. Pat. No. Re 29,638 that includes a valve element which responds to changes in the pressure of fluids in the annulus 12 in order to open and close a flow passage extending upwardly through the valve assembly. The lower end of the main test valve assembly 11 is connected to a recorder sub 13 that houses a pressure recorder which records the pressure of fluids in the passage as a function of elapsed time as the test proceeds. The lower end of the recorder sub 13 is connected to a pressure transfer sub 14 having lateral ports 15 in communication with the well annulus, and the transfer sub is connected to a seal nipple 16 which extends downwardly through the bore of a packer 17 of conventional construction. The packer 17, which can be a permanent-set device, typically includes normally retracted slips and packing elements which can be expanded to provide an anchored packoff in the well casing 18. The mandrel of the packer has a seal bore which receives the seal nipple 16, and an upwardly closing valve element such as a flapper element 20 serves to automatically close the bore to upward flow of fluids when the seal nipple and components therebelow are withdrawn.

A slotted or perforated section of tail pipe 21 is connected below the seal nipple 16 and functions to enable formation fluids to enter the flow passage through the tools when the valve element included in the main test valve assembly 11 is open. The lower end of the tail pipe 21 is connected to a hydraulically operable firing sub 22 that is constructed in accordance with the present invention. The firing sub 22 is arranged to cause the selective operation of a perforating gun 23 which is connected to its lower end, the gun including a plurality of explosive charges (e.g. shaped-charges) that upon detonation provide perforations through the wall of the casing 18 and into the formation to enable connate formation fluids to enter the well bore. Another recorder 24 may be connected to the lower end of the perforating gun 23 to provide for additional pressure records.

Figure 2A:
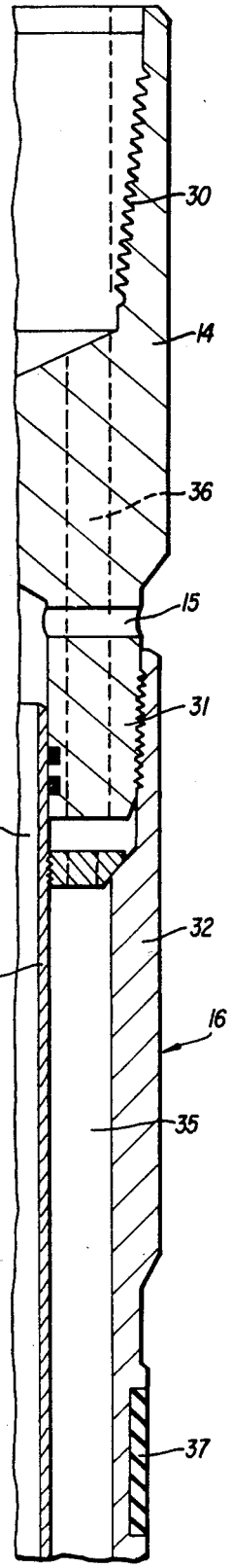
FIGS. 2A–2D are longitudinal sectional views (right side only) of a portion of the system of FIG. 1, each successive drawing figure forming a lower continuation of the preceding figure.
Figure 2B:
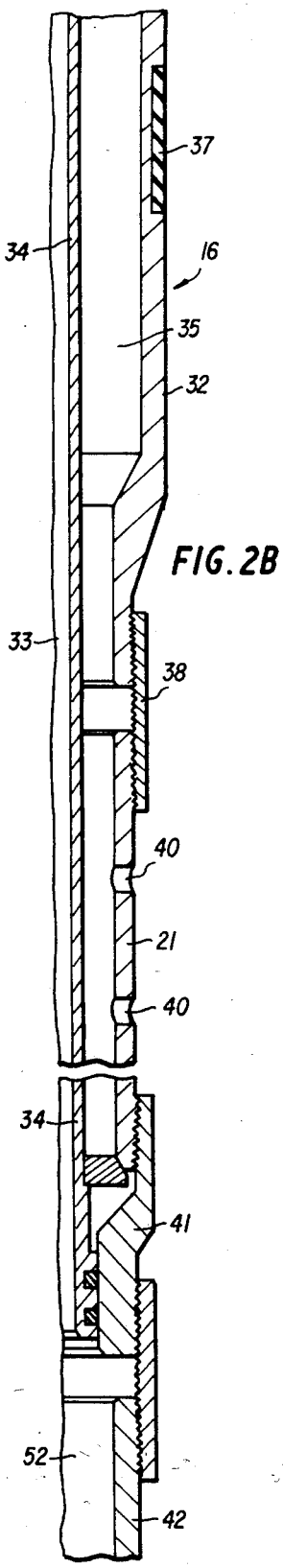

Turning now to FIG. 2A for a detailed illustration of the various structural components of the embodiment, the pressure transfer sub 14 has a threaded box 30 for connection to the recorder housing 13 and a threaded pin 31 for connection to the upper end of the mandrel 32 of the seal nipple 16. A plurality of radially directed ports 15 extend through the wall of the sub 14 to communicate the well annulus above the packer 17 with the interior bore 33 of a small diameter pressure tube 34 which extends downwardly through the seal nipple mandrel 32. The annular space 35 between the inner wall of the seal nipple 16 and the outer wall of the tube 34 provides a portion of the test passage which is communicated by vertical ports 36 with the test passage section above the transfer sub 14. Typical seal elements 37 are carried on the outer periphery of the seal nipple, and engage wall surfaces of the packer mandrel to prevent fluid leakage.

The lower end of the seal nipple 16 is connected by a collar 38 to the upper end of the slotted tail pipe 21 which has a plurality of ports 40 through which formation fluids can enter. An adapter sub 41 and a collar connect the lower end of the tail pipe 21 to a section of tubing 42 which can be used to space the firing sub and perforating gun a selected distance below the packer 17. The lower end of the pressure tube 34 is sealed by "O"-rings with respect to the adapter sub 41.

Figure 2C:
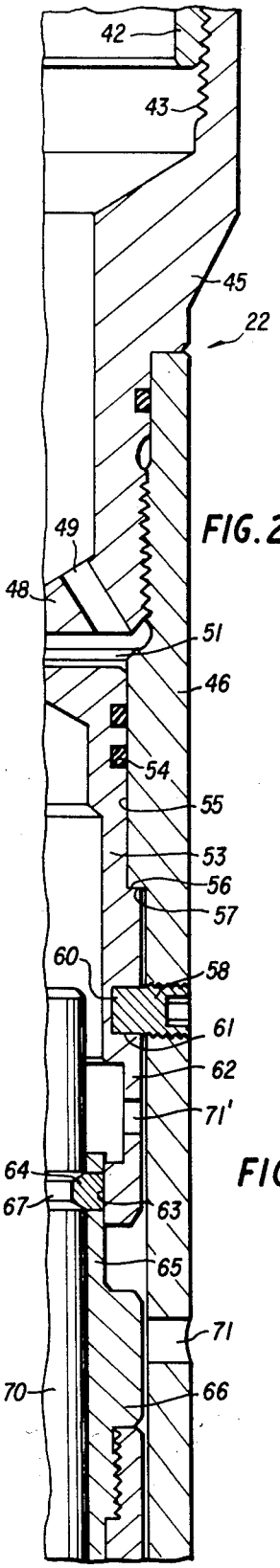
Figure 2D:
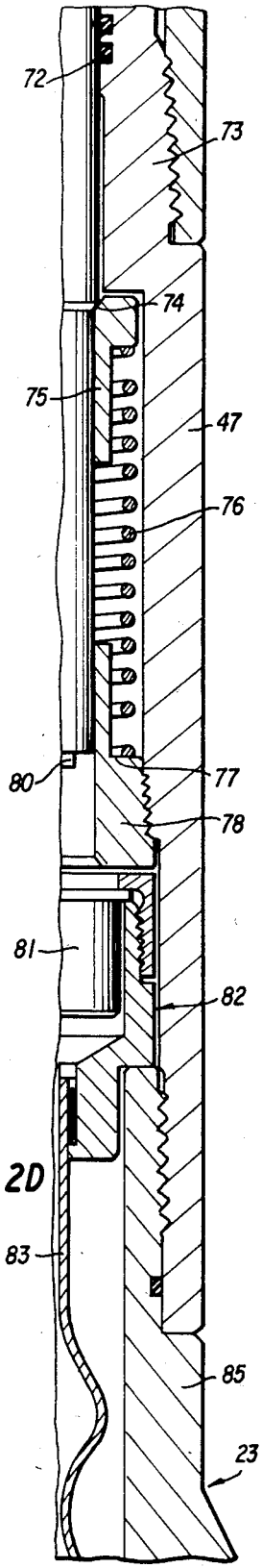

As shown in FIG. 2C, the lower end of the tubing section 42 is connected by threads 43 to the upward end of the firing head assembly 22. The assembly 22 includes an upper adapter 45 that is threaded to an upper housing section 46 which, in turn, is threaded to a lower housing section 47. The adapter 45 has a transverse wall section 48 provided with ports 49 to communicate the interior bore 51 of the housing section 46 with the bore 52 of the tubing 42 and thus with the bore 33 of the pressure tube 34 thereabove. Movably received in the bore of the housing section 46 is an actuator sleeve piston 53 carrying seal rings 54 that engage a cylindrical wall surface 55 of the housing section 46. The sleeve piston 53 has a closed upper end, and an external upwardly-facing shoulder 56 that normally engages a downwardly-facing shoulder 57 on the housing section 46. A shear pin 58 that is threaded into the wall of the housing section 46 has an inner end portion 60 that engages in an external annular groove 61 of the piston 53. The lower end portion 62 of the sleeve piston 53 provides an inwardly-facing annular locking surface 63 that normally engages a plurality of circumferentially spaced dogs 64 which extend through windows in the upper end section 65 of an extension sleeve 66 and into engagement with an annular groove 67 formed in the upper end of an elongated firing pin 70. When engaged as shown, the dogs 64 prevent axial movement of the firing pin 70 from the position shown in FIG. 2C. One or more ports 71 extend through the wall of the housing section 46 to communicate the interior region of the sleeve piston 53 via one or more ports 71' and the upper end surface of the firing pin 70 with the pressure of fluids in the isolated interval of the well below the packer 17.

The firing pin 70 extends downwardly through a seal 72 (FIG. 2D) on the upper end portion 73 of the lower housing section 47, and is provided with a downwardly facing shoulder 74 against which a retainer 75 is pressed by a coil spring 76. The lower end of the spring 76 bears against an upwardly facing shoulder 77 on a guide ring 78 that is threaded into the housing section 47. The lower end of the firing pin 70 is provided with a protrusion 80 that is adapted upon downward movement of the pin 70 to impact and cause firing of a detonator in the form of a percussion cap 81 mounted in a retainer assembly 82. The upper end of a length of Primacord TM detonating cord 83 is fitted into the lower end of the retainer assembly 82 and is arranged in a well known way to burn when the cap 81 is detonated. The detonating cord 83 extends downwardly within the housing 85 of the perforating gun assembly 23 which is sealed at atmospheric pressure in a conventional manner. The burn of the cord detonates the shaped charges to cause perforation of the casing 18 in a well-known manner. In operation, the parts and components of the embodiment of the perforating system are assembled as shown in FIGS. 1 and 2A–2D. The packer 17 is set in the well casing in a conventional manner to isolate an interval of the well bore. The tool string is lowered into the well, its lower end being inserted through the bore of the packer 17, pushing the flapper valve 20 open. The tool string descends until the seal nipple 16 enters and stops within the packer mandrel bore in order to seal off the interval of the well below the packer from the hydrostatic pressure of the fluid standing in the well annulus above the packer. The pipe string 10 may be filled with a column of water to provide a cushion in order to enable control of the pressure differential when the test valve assembly 11 is opened.

To open the test valve assembly 11, pressure is applied at the surface to the well annulus 12 to actuate the valve element therein in the manner disclosed in Nutter U.S. Pat. No. Re 29,638. This pressure acts via the transfer sub ports 15, the pressure tube 34 and the bore of the tubing 42 on the upper end surface of the sleeve piston 53. The strength of the shear pin 58 is selected so that it will not fail and thereby enable release of the firing pin 70 until a greater differential is applied thereto than is employed to activate the main test valve assembly 11.

With the main valve 11 open, suitable valves can be manipulated at the surface to slowly bleed down the pressure in the pipe string 10 to thereby increase the pressure differential acting on the sleeve piston 53 until the pin 58 shears. When the pin 58 shears, the sleeve piston 53 moves suddenly downward to position the locking surface 63 below the latch dogs 64, which then shift outwardly to release the firing pin 70. The firing pin 70 is then forced downwardly by the pressure in the well bore below the packer, and impacts the percussion cap 81 to cause the same to ignite the detonating cord 83, thereby firing the perforating gun 23. Since the pressure in the isolated interval of the well has been substantially reduced, the perforations are made under conditions of "underbalance," i.e., the pressure in the well bore is less than the formation fluid pressure, so that there is an immediate cleansing effect as formation fluids enter the well casing. Since all fluid flow is toward the well bore, the formation is not damaged as may happen where perforating is done under overbalanced conditions.

Once communication has been established through the casing between the formation and the isolated well interval, a test of the well can be carried out in the customary manner by closing and opening the valve in the test assembly 11 to alternately shut-in and flow the formation. The flow and shut-in pressures are recorded by the gauges at 13 and 24. After completion of testing, the tool string may be withdrawn from the packer element 17 and removed from the well. The packer 17 remains in position for subsequent production operations.

Although the use of a permanent-type production packer 17 has been illustrated and described herein, it will be appreciated that a typical retrievable type packer could be used which is an integral part of the tool string located between the transfer, sub 14 and the slotted tail pipe 21. In this case of course the packer element would be run into the well casing with the tool string and operated to temporarily pack off the well interval to be perforated and tested.

FIGS. 3A–3D illustrate a modified form of embodiment of well perforating system disposed as part of a tubing string. The embodiment of FIGS. 3A–3D is a "full-bore" embodiment that may be run together with testing tools, or without any testing tools as part of a permanent well completion system. As shown in the drawings, the perforating tools are incorporated into the string in such a way that the central bore is unobstructed. This offers the advantage that tools can be run on wireline or narrower diameter piping down through the tubing string, unhindered by the perforating system components. Furthermore, the unobstructed central bore is available to serve as a conduit for passing the fluids produced by the well after perforation.

The firing mechanism in the arrangement of FIGS. 3A–3D has a general annular construction, the firing pin and actuating assemblies being arranged within the tubing string, peripherally of its central bore.

Figure 3A:
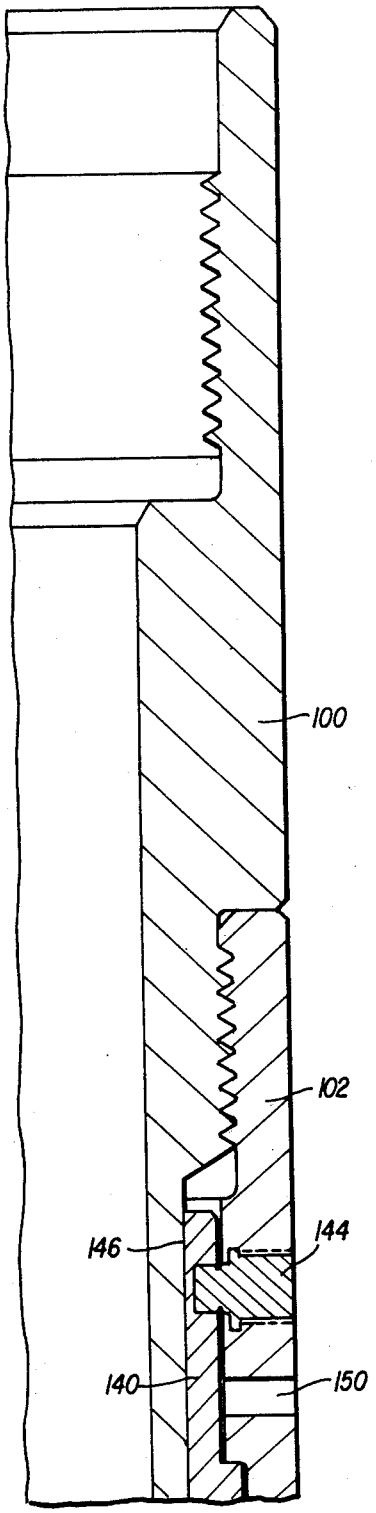
FIGS. 3A–3D are views corresponding to those of FIGS. A–2D of a modified form of the well perforating system shown in FIGS. 1 and 2A–2D.
Figure 3B:
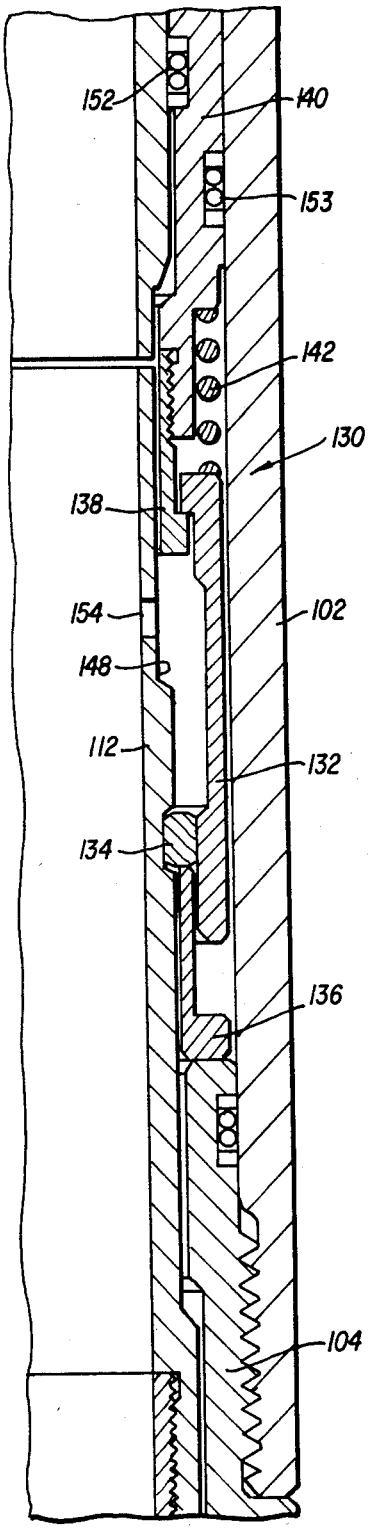
Figure 3C:
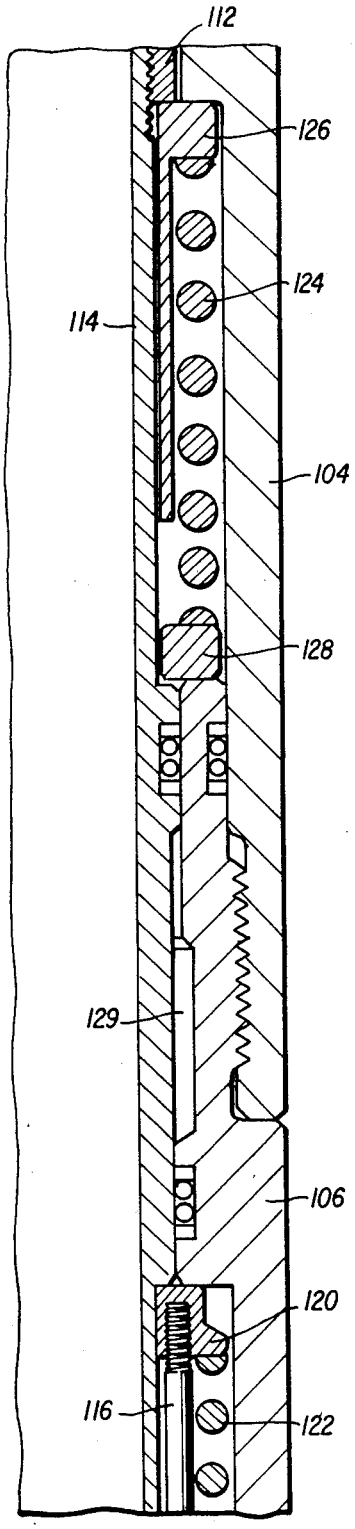
Figure 3D:
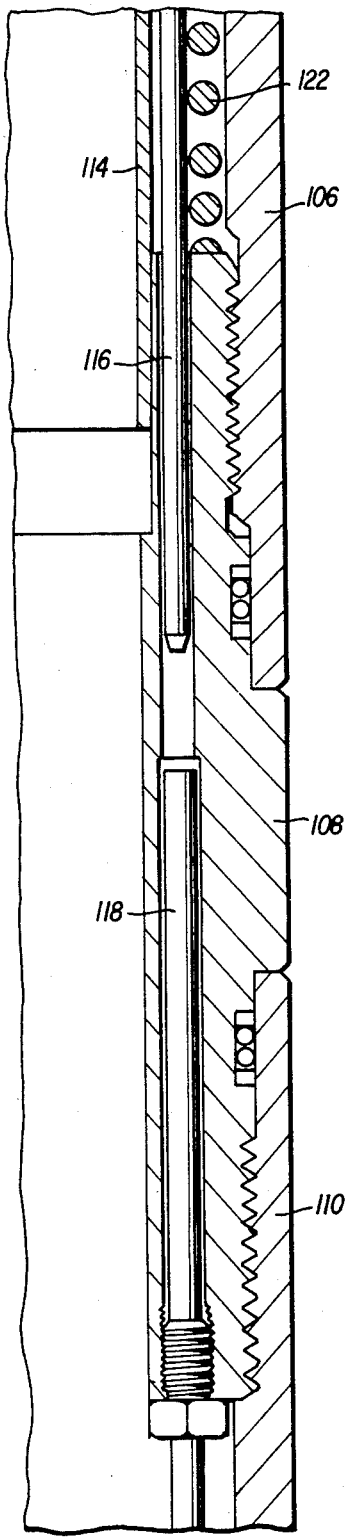

As shown in FIGS. 3A–3D, a top sub 100 having a full bore therethrough includes a threaded box at its upper end for connection in the tubing string. A plurality of tubular members successively connected below the top sub 100 serve to house the perforating system elements as part of the tubing string, providing a constant outside diameter and an unobstructed central bore throughout. These other tubular members include a shear pin housing 102 threadably engaged to an intermediate portion of the top sub 100, (FIGS. 3A–3B); a spring housing 104 threadably connected below the housing 102 (FIGS. 3B–3C); a firing pin housing 106 threadably connected below the housing 104 (FIGS. 3C–3D); and a detonator housing 108 threadably connected to the housing 106 (FIG. 3D). The detonator housing 108 provides a point of connection for the rest of the tubing string 110 which includes a perforating gun. Such other tools and tubing string elements, (e.g. slotted section of tail pipe, test tools and so forth) may be connected in the lower part of the tubing string 110, as desired for the particular application. The "full-bore" perforating system arrangement of FIGS. 3A–3D provides great latitude as to its point of connection in the tubing string. The firing mechanism may even be connected to be entirely above the location of a packer used to isolate the well interval being perforated. In such case, a lengthened detonating cord may be extended down the periphery of the tubing through the packer and into connection with the perforating gun located below the packer.

A firing mechanism actuator in the form of a tubular piston is slidably mounted within the housing members 100, 102, 104, 106 and 108 as shown in FIGS. 3B–3D. The actuator comprises upper and lower sections consisting of a latch mandrel 112 threadably engaged above a firing pin actuator sleeve assembly 114. The actuator piston is mounted to move longitudinally of the tubing string from a position in which the top of the latch mandrel 112 abuts the bottom of a narrowed outside diameter portion of the top sub 100 (FIG. 3B) to a position in which the bottom of the sleeve assembly 114 is brought into contact with an inside shoulder formed by a widened inside bore portion at the top of the detonator housing 108.

The actuator piston assembly is mounted so that when it is driven to its downward position, it drives a firing pin 116 downwardly against a percussion detonator 118 (FIGS. 3C–3D), thereby causing the firing of a plurality of explosive charges mounted within a perforating gun carried in the lower part of the tubing string 110.

The firing pin 116 is in the form of a pointed rod that depends from an annular spring retaining element 120 (see FIG. 3C). The bottom of the firing pin 116 is received within a tubular bore of the detonator housing 108 that extends parallel to the axis of the tubing string. The detonator 118 is also rod-like and projects upwardly into a larger diameter portion of the same bore at the lower part of the housing 108. A Primacord TM detonating cord or other suitable means for delivering the detonation effect from the detonator 118 to the explosive charges located in the perforating gun is connected below the detonator 118.

A helical spring 122 is positioned within a cavity formed by a reduced outside diameter lower part of the sleeve assembly 114, a greater inside diameter lower portion of the firing pin housing 106 and the top of the detonator housing 108. The spring 122 connects between the top of the housing 108 and the spring retaining element 120 and serves to bias the firing pin 116 in a position spaced from the detonator 118, with the top of the element 120 abutting the internal shoulder at the top of the larger inside diameter portion of the housing 106. For ease of operation it has been found advantageous to provide a plurality of firing pins 116 depending at evenly spaced locations from the annular element 120 into a corresponding plurality of peripheral bores in the housing 108. It is sufficient that only one of the bores be provided with a detonator 118. However, the firing pins not mating with a detonator act as guides to ensure the smooth movement of the firing pin that does mate with a detonator.

A second helical spring 124 is positioned within an annular cavity formed by the lower larger inside diameter portion of the spring housing 104, the upper outer portion of the sleeve assembly 114, the bottom of the latch mandrel 112, and the top of the firing pin housing 106 (FIG. 3C). The spring 124 is received between an annular spring guide 126 at the top of the cavity and a spring washer 128 positioned at the bottom of the cavity. The top of the spring guide 126 abuts an internal shoulder of the housing 104 and the bottom of the mandrel 112, as shown in FIG. 3C. A sealed atmospheric chamber 129 is provided between the inner surface of the housing 106 and the outer surface of the actuator sleeve 114. The spring 124 serves to bias the actuator piston 112, 114 in its upmost position with the top of the mandrel 112 positioned adjacent the bottom of the top sub 100. The atmospheric chamber 129 acts to bias the piston 112, 114 downwardly when pressure is greater in the central bore.

The actuator piston 112, 114 is locked in its upmost position by means of a latch or locking mechanism 130. The locking mechanism 130 includes a latch 132 (FIG. 3B) which locks a split latch ring 134 into engagement with an external annular groove or recess of the latch mandrel 112. A latch stop ring 136 positioned above the top of the spring housing 104 supports the split ring 134 against downward movement. When the ring 134 is within the external groove of the mandrel 112, the piston actuator 112, 114 is locked against downward movement, and activation of the firing element 116 is prevented. The top of the latch 132 includes an internal downwardly-facing shoulder which engages with an external upwardly-facing shoulder of an extension element 138 threadably engaged to the bottom of a latch piston 140. The two shoulders are urged into engagement by a latch spring 142, as shown in FIG. 3B. A shear pin 144 extending through a bore in the upper section of the shear pin housing 102 between the housing 102 and the latch piston 140 immobilizes the latch piston 140 against downward movement (FIG. 3A). The components of the latch mechanism 130 are received within the annular cavity defined by an upper section 146 and a lower section 148.

One or more ports 150 (FIG. 3A) serve to maintain the pressure in the upper section 146 at equilibrium with the pressure in the annulus of the borehole. Seals 152 and 153 (FIG. 3B) serve to isolate the lower section of the cavity 148 from the pressure in the upper section of the cavity 146. One or more ports 154 (FIG. 3B) in the latch mandrel 112 serve to equalize the pressure in the lower cavity section 148 with that of the internal central bore of the tubing string. It can be seen therefore from the arrangement of FIGS. 3A and 3B that the pressure difference between the pressure in the annulus delivered at the port 150 and the pressure in the central bore of the tubing string delivered at the location of the port 154 is caused to act on the latch piston 140. Should the annular pressure acting on the upper cavity section 146 exceed the tubing bore pressure acting on the lower cavity section 148 by an amount greater than the shear strength of the pin 144, the latch piston 140 will be driven downwardly against the latch 132. Use of the mating shoulder and spring arrangement of the latch mechanism 130 (shown by elements 132, 138, 140 and 142 in FIG. 3B) serves to isolate the force necessary to shear the pin 144 from the effect of the inertial and frictional forces associated with the consequential downward movement of the latch 132. An interval of "dead" travel is provided between the shearing of the pin 144 and the point at which the downward travel of the bottom of the latch piston 140 pushes the latch 132 down. This ensures a "clean" shear of the pin 144.

In operation in a typical commercial application, the pressure applied to the upper cavity section 146 will be the pressure of fluid in the annulus of the borehole above a packer that has been set to isolate the well interval to be perforated. The pressure applied to the lower cavity section 148 will typically correspond to the pressure of fluid in the isolated interval below the packer. The shear strength of the pin 144 and the spring constants of the springs 122, 124 and 142 are selected so that when the desired pressure difference between the annulus and the tubing bore exists, the pin 144 will break, the latch mechanism 130 will be released and the actuating piston 112, 114 will drive the firing pin 116 downward against the detonator 118. When the pin 144 breaks, the latch piston 140 is forced downwardly by the pressure differential applied across it. After a brief interval of "dead" travel, the latch piston 140 comes into contact with the latch 132, pushing it downward to a point where a larger inside diameter portion of the latch 132 moves into position adjacent to the split latch ring 134. The latch ring 134 will travel out of the external groove of the mandrel 112, thereby freeing the actuator piston 112, 114 for downward movement against the bias of both the spring 124 and the chamber 129, and driving the firing pin 116 against the bias of the spring 122 into percussive engagement with the detonator 118, thereby firing the gun.

Having thus described the invention with particular reference to the preferred forms thereof in the context of perforating systems incorporated into a tubing string, it will be obvious to those skilled in the art to which the invention pertains, after understanding the invention, that various changes and modifications may be made therein without departing from the spirit and scope of the invention as defined by the claims appended thereto.

What is claimed is:

1. Firing appartus for use with a well perforating gun of the type having a carrier containing a plurality of shaped-charges, and detonating means for actuating said charges, comprising:

a tubular housing adapted to be connected to said carrier;

firing pin means mounted in said housing for movement from a first position spaced from said detonating means to a second position impacting said detonating means, said firing pin means having a transverse cross-sectional area subject to well pressure to cause such movement;

releasable means for locking said firing pin means in said first position; and differential pressure responsive means for releasing said locking means to enable said well pressure to move said firing pin means to said second position;

wherein said locking means comprises laterally shiftable latch means on said housing, said latch means being movable from an inner position engaging detent means in said firing pin means to an outer position disengaged from said detent means, and locking surface means on said differential pressure responsive means normally engaging said latch means for preventing movement thereof to said outer position.

2. The apparatus of claim 1 wherein said differential pressure responsive means includes piston means sealingly arranged within cylinder means in said housing, said locking surface means being formed on said piston means, said piston means being movable from an upper position where said locking surface means engages said latch means to a lower position where said locking surface means is disengaged from said latch means, and shear means for retaining said piston means in said upper position, said shear means being disrupted in response to downward force of a predetermined magnitude.

3. The apparatus of claim 2 wherein said piston means has upwardly and downwardly facing transverse pressure surfaces, and further including first port means for communicating the pressure of well fluids adjacent said housing to said downwardly facing pressure surface, and second port means for communicating an applied fluid pressure to said upwardly facing pressure surface, whereby a differential fluid pressure can be applied to said piston means to generate the downward force necessary to disrupt said shear means.

4. A well perforating system, comprising:

a packer for isolating an interval of a well bore;

a pipe string associated with the packer for establishing fluid communication between the isolated interval and the well surface;

a perforating device, including a detonator, suspended below the packer and adapted when fired to perforate the well in the isolated interval; and a firing mechanism including a housing associated with the perforating device, a firing element mounted within the housing for firing the detonator, and a locking mechanism mounted relative to the housing for movement from a first position in which operation of the firing element is inhibited to a second position in which operation of the firing element is permitted;

means for moving the locking mechanism from the first to the second position in response to a first predetermined pressure difference; and means for operating the firing element in response to a second predetermined pressure difference.

5. A system as in claim 4, further comprising valve means connected in the pipe string and responsive to a third predetermined pressure difference for controlling the establishment of fluid communication between the isolated interval and the well surface.

6. A firing apparatus for use with a well perforating system including a packer for isolating an interval of a well bore; a pipe string associated with the packer for establishing fluid communication between the isolated interval and the well surface; and a perforating device, including a detonator, suspended below the packer and adapted when fired to perforate the well in the isolated interval; comprising:

a housing adapted to be associated with the perforating device;

a firing element mounted within the housing for firing the detonator; and a locking mechanism mounted relative to the housing for movement from a first position in which operation of the firing element is inhibited to a second position in which operation of the firing element is permitted;

means for moving the locking mechanism from the first to the second position in response to a first predetermined pressure difference, and means for operating the firing element in response to a second predetermined pressure difference.

7. A system as in claim 4, 5 or 6, wherein the first predetermined pressure difference is a predetermined difference between the pressure of fluid in the isolated interval and the pressure of fluid in an annulus defined between the pipe string and the walls of the well bore above the packer; and wherein the second predetermined pressure difference is a predetermined pressure difference between the pressure of fluid in the isolated interval and a reference pressure.

8. A system as in claim 7, wherein the locking mechanism comprises a piston, and the means for moving the locking mechanism comprises a shear pin connected between the housing and the piston, the shear pin being designed to break when the first pressure difference is applied across the piston.

9. A system as in claim 8, wherein the locking mechanism further comprises a laterally shiftable latch member movable from an inner position engaging the firing element to an outer position disengaged from the firing element, the piston including a projecting surface portion and being movable from a first position in which the projecting portion abuts the latch member to prevent outward movement thereof to a second position in which the projecting portion is removed from the latch member to permit outward movement thereof.

10. A system as in claim 9, wherein the reference pressure is atmospheric pressure; and wherein the firing element comprises a firing pin adapted to be driven against the detonator when the second predetermined pressure is applied across it.

* * * * *